United States Patent [19]

Nnadi

[11] 4,066,561

[45] Jan. 3, 1978

[54] ORGANOMETALLIC COMPOUNDS AND COMPOSITIONS THEREOF WITH LUBRICANTS

[75] Inventor: John C. Nnadi, Glassboro, N.J.

[73] Assignee: Mobil Oil Corporation, New York, N.Y.

[21] Appl. No.: 558,022

[22] Filed: Mar. 13, 1975

Related U.S. Application Data

[63] Continuation-in-part of Ser. No. 430,869, Jan. 4, 1974, abandoned.

[51] Int. Cl.[2] ..... C10M 1/40

[52] U.S. Cl. ..... 252/33.4; 252/42.7; 252/46.7; 252/49.7; 252/400 R

[58] Field of Search ..... 252/46.4, 33, 400 R, 252/400 A, 33.4, 40.5, 42.7, 46.7, 49.7, 32.5, 47.5

[56] References Cited

U.S. PATENT DOCUMENTS

| | | | |
|---|---|---|---|
| 2,263,445 | 11/1941 | Reiff | 252/47.5 X |
| 2,263,445 | 11/1941 | Reiff | 252/46.4 |
| 2,345,239 | 3/1944 | Cook et al. | 252/47.5 X |
| 2,346,808 | 4/1944 | Winning et al. | 252/47.5 X |
| 2,692,859 | 10/1954 | Talley et al. | 252/32.5 X |
| 2,695,910 | 11/1954 | Asseff et al. | 252/32.5 X |
| 2,721,176 | 10/1955 | Cantrell et al. | 252/46.4 |
| 2,848,444 | 8/1958 | Brugmann et al. | 252/47 |
| 3,544,463 | 12/1970 | Koft | 252/32.5 X |
| 3,632,600 | 1/1972 | Morris | 252/33 |

FOREIGN PATENT DOCUMENTS

| | | | |
|---|---|---|---|
| 707,157 | 4/1954 | United Kingdom | 252/33 |

*Primary Examiner*—Delbert E. Gantz
*Assistant Examiner*—Andrew M. Metz
*Attorney, Agent, or Firm*—Charles A. Huggett; Dennis P. Santini

[57] ABSTRACT

Metallic compounds of polyarylamine sulfides and polyarylamine-phenol sulfides are provided. Said compounds function as dispersants and lubricants are stabilized against oxidation and have their wear protection properties improved by adding thereto a property improving amount of one or more of said compounds.

11 Claims, No Drawings

ORGANOMETALLIC COMPOUNDS AND COMPOSITIONS THEREOF WITH LUBRICANTS

CROSS-REFERENCE TO RELATED APPLICATION

This is a continuation-in-part of application Ser. No. 430,869, filed Jan. 4, 1974 now abandoned.

BACKGROUND OF THE INVENTION

1. Field of the Invention

The present invention relates to a new class of compounds identified as metallic compounds of polyarylamine sulfides and polyarylamine-phenol sulfides. It further relates to improved lubricant compositions. More particularly, it relates to lubricants which have been improved by the addition thereto of one or more of said compounds.

2. Discussion of the Prior Art

It is well known that many organic liquids and solids used in industrial fluids, such as oils and greases, power transmission fluids and the like, may deteriorate and lose their ability to function when subjected to oxidation. Since these substances are very often used at high temperatures, the rate of oxidation breakdown can be very rapid. This problem is particularly important in the operation of present day automotive and aircraft engines.

The breakdown of lubricant is almost always accompanied by the formation of sludge, corrosive acids and other products. These can harm the metal surfaces of engines or other machines and interfere with efficient operation of the lubricant.

No art is known which discloses the compounds taught herein. There are numerous other compounds, however, taught in the art which impart property improvement to lubricants in combination therewith. For instance, U.S. Pat. Nos. 3,156,728, and 3,224,972 teach 4,4-thiobis[2,6-di(lower alkyl) aniline] compounds for the purpose of imparting antioxidant properties to organic compositions therewith. Further, U.S. Pat. No. 2,848,444 teaches lubricant compositions containing a reaction product of a metal polysulfide and diphenylamine, or an alkyl derivative thereof, having improved oxidation and corrosion properties. U.S. Pat. No. 3,217,038 teaches the use of an alkylthioalkyl diaminodiphenylalkane for the purpose of imparting stabilization to an organic substance by mixture therewith. Also, in U.S. Pat. No. 3,347,792 teaches lubricant compositions containing a reaction product of (1) ammonia, a primary amine or a secondary amine with (2) carbon disulfide and (3) an aliphatic epoxide.

U.S. Pat. No. 3,844,956 relates to improving lubricants by adding thereto an amount of an amino-substituted polyphenylthioether, an intermediate compound in the manufacture of the compounds of the present invention.

SUMMARY OF THE INVENTION

In accordance with this invention, there is provided the new class of compounds identified as metallic compounds of polyarylamine sulfides and polyarylamine-phenol sulfides having the general chemical formula:

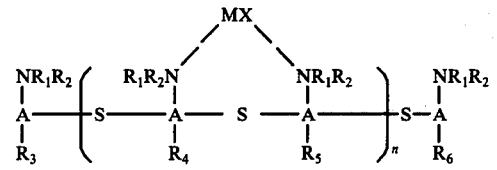

wherein $n$ is an integer of from 1 to about 10, preferably from 1 to about 5;

A is an aromatic moiety, preferably phenyl or naphthyl;

M is a polyvalent metal, such as, for example, Be, Mg, Ca, Ba, Mn, Co, Ni, Pd, Cu, Zn and Cd;

X is a radical selected from the group consisting of organophosphoro, organocarboxyl, organoamino, organosulfonyl, organothio, organooxy, nitrate, nitrite, phosphate, sulfate, sulfonate, oxide, hydroxide, carbonate, sulfite, fluoride, chloride, bromide and iodide;

$R_1$ and $R_2$ are alkyl of from 1 to about 10 carbon atoms, aryl, hydrogen,

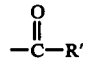

or a combination thereof;

R′ is alkyl of from 1 to about 10 carbon atoms, aryl or hydrogen;

$R_3$, $R_4$, $R_5$ and $R_6$ are hydrogen, alkyl of from 1 to about 200 carbon atoms, aryl, alkyl-substituted aryl where the alkyl substituent is comprised of from 1 to about 200 carbon atoms, carboxyaryl, carbonylaryl, aminoaryl, mercaptoaryl, halogenoaryl or combinations thereof.

It is noted that the $-NR_1R_2$ functions in the above chemical formula may be the same or different within an individual molecule of the compound of the present invention.

Also in accordance herewith, there is provided a lubricant composition comprising a major proportion of a lubricant and an antioxidant amount of one or more of the above compounds.

DESCRIPTION OF SPECIFIC EMBODIMENTS

Compounds of the present invention may be made by the general method of reacting the polymer of this invention with a suitable compound containing the desired metals or by first forming the salt of complex of the alkylphenol or alkylaniline and then sulfurizing to make the polymer. U.S. Pat. No. 3,844,956, the disclosure of which is incorporated herein by reference, shows preparation of an intermediate useful in preparation of the present compounds. Said intermediate may be reacted with suitable compounds, such as metallic salts (e.g., zinc sulfate) to yield the present compounds.

The organic or inorganic molecule or radical of the compounds of the present invention, i.e., X, may be supplied as, for the inorganic molecule or radical, sulfates, sulfides, halides, phosphates, oxides, carbonates, hydroxides or others of Ni, Mg, Zn, Al, Sn, Fe or others and for the organic molecule or radical, phosphates, phosphonates, sulfonates, sulfates, carboxylates, phenates, alcoholates, thioacid salts, metal mercaptans or others of Ni, Mg, Zn, Al, Sn, Fe or others.

Non-limiting examples of suitable metal compounds useful in preparation of the compounds of this invention from intermediates such as shown in U.S. Pat. No. 3,844,956 include the following: metal acetates, metal oleates, zinc polypropylphenylphosphate, zinc oxide, calcium oxide, calcium carbonate, calcium acetate, zinc sulfate, calcium chloride, sodium hydroxide, lithium hydroxide, magnesium oxide, magnesium hydroxide, barium oxide and barium hydroxide.

The compounds of this invention can be used in a wide variety of lubricant media. They can be used as effective agents in lubricating oils such as mineral oils, both naphthenic and paraffinic, including these containing substantial amounts of aromatic oils, synthetic oils, such as synthetic hydrocarbons obtained by polymerizing olefins, synthetic esters and polysiloxanes and the like. The term "lubricant" also includes greases made by adding a grease forming agent to any of those oils mentioned, but is not meant to include any of the compounds themselves as lubricants. The compounds disclosed herein are especially useful in providing detergency and in stabilizing a lubricating oil made by reacting an aliphatic monocarboxylic acid containing from 4 to 10, preferably 5 to 9, carbon atoms with pentaerythritol, including mono and dipentaerythritol or mixtures thereof. A widely used synthetic lubricating oil is made from monopentaerythritol and a mixed $C_5$–$C_9$ acid, preferably $C_5$ and $C_9$.

For the purpose of non-limiting illustration of the present invention, the following examples are presented.

EXAMPLE 1

Zinc Oxide Complex

A 100 gram sample of polydodecylaniline sulfide (50% active ingredient and 50% process oil), 25 cc of water and 3 grams of zinc oxide (ZnO) were mixed together and heated to gradually distill off the water. The mixture was held at about 150° C for 1 hour under atmospheric pressure and at 150° C for 1½ hours under house vacuum. The remaining residue was filtered through a funnel packed with hiflo filter aid on filter paper. The product filtrate weighed 80 grams. Chemical analysis of the product gave the following results in weight percent:

N — 2.51
S — 2.16
Zn — 0.81

In terms of the above general chemical formula, $n$ is O, $R_1$ and $R_2$ are hydrogen and $R_3$ and $R_6$ dodecyl or hydrogen for the compound of this example.

EXAMPLE 2

Zinc Methane Sulfonate Complex

A 210 gram sample of the polydodecylaniline sulfide of Example 1, 5 grams zinc methane sulfonate and 40 grams of water were mixed together and heated to gradually distill off the water. The mixture was heated and filtered as in Example 1 and 185 grams of product filtrate was obtained. Chemical analysis of the product gave the following results in weight percent:

N — 2.44
S — 3.32
Zn — 0.68

In terms of the above general chemical formula, $n$ is 1, $R_1$ and $R_2$ are hydrogen and $R_3$, $R_4$, $R_5$ and $R_6$ are dodecyl or hydrogen for the compound of this example.

EXAMPLE 3

Zinc Oleate Complex

A 200 gram sample of the polydodecylaniline sulfide of Example 1, 20 grams of oleate and 25 cc of water were mixed together, heated and filtered as in Example 1. A total of 199.7 grams of product filtrate was obtained. Chemical analysis of the product gave the following results in weight percent:

N — 2.35
S — 2.44
Zn — 0.58

In terms of the above general chemical formula, $n$ is 2, $R_1$ and $R_2$ are hydrogen and $R_3$, $R_4$, $R_5$ and $R_6$ are dodecyl or butyl for the compound of this example.

EXAMPLE 4

Zinc Polypropylphenylphosphate Complex

A 110 gram sample of zinc polypropylphenylphosphate, 55 grams of the polydodecylaniline sulfide of Example 1 and 40 cc of water were mixed, heated and filtered as in Example 1. A total of 160.7 grams of product filtrate was obtained. Chemical analysis of the product gave the following results in weight percent:

N — 0.73
S — 0.80
Zn — 0.72

In terms of the above general chemical formula, $n$ is 3, $R_1$ and $R_2$ are hydrogen and $R_3$, $R_4$, $R_5$ and $R_6$ are dodecyl or methyl for the compound of this example.

EXAMPLE 5

A 100 gram (50 percent active) sample of dodecylaniline sulfide (prepared by reacting 2 moles of dodecylaniline hydrochloride with 1 mole $SCl_2$) was mixed with 50 ml. of water and 5 grams of zinc methane sulfonate. The reaction mixture was heated at reflux for 1 hour, then at 150°–160° C to remove all water. It was held at 160°–170° C under house vacuum and nitrogen for 1½ hours. The resulting mixture was filtered as in Example 1. A total of 89 grams of product filtrate was obtained which had a chemical analysis, in weight percent, as follows:

N — 2.50
S — 3.40
Zn — 0.70

In terms of the above general chemical formula, $n$ is 0, $R_1$ and $R_2$ are hydrogen, $R_3$ and $R_6$ are dodecyl or hydrogen and MX is zinc methane sulfonate for the compound of this example.

EXAMPLE 6

A 50 percent active 100 gram sample of polydodecylaniline sulfide (prepared by the reaction of 6 moles of dodecylaniline hydrochloride and 5 moles of $SCl_2$) was mixed with 50 ml. of water and 5 grams of zinc methane sulfonate. The reaction mixture was heated and filtered as in Example 5 to yield 83 grams of product filtrate. Chemical analysis of the product proved it to have 0.6 weight percent zinc. In terms of the above general chemical formula, $n$ is 2, $R_1$ and $R_2$ are hydrogen, $R_3$, $R_4$, $R_5$ and $R_6$ are dodecyl or hydrogen and MX is zinc methane sulfonate for the compound of this example.

EXAMPLE 7

A 50 percent active 100 gram sample of a compound prepared by reacting 5 moles of dodecylaniline hydrochloride and 3 moles of N,N-dimethylaniline hydrochloride with seven moles of $SCl_2$ were mixed with 50 ml. of water and 6 grams of zinc acetate. The reaction mixture was heated and filtered as in Example 5 to yield 85 grams of product filtrate which had a zinc content in weight percent of 0.7. In terms of the above general chemical formula, $n$ is 3, $R_1$ and $R_2$ are methyl, $R_3$, $R_4$, $R_5$ and $R_6$ are dodecyl or hydrogen and MX is zinc acetate for the compound of this example.

EXAMPLE 8

In this example, 100 grams of 50 percent active compound prepared by reacting 4 moles of dodecylaniline hydrochloride and 2 moles of alpha - napththylamine hydrochloride with $SCl_2$ is mixed with 50 cc of water and 5 grams of zinc methane sulfonate. The reaction mixture is heated and filtered as in Example 5 to yield product filtrate wherein, according to the general chemical formula hereinbefore presented, $n$ is 2, $R_1$ and $R_2$ are hydrogen, A is phenyl or naphthyl, $R_3$, $R_4$, $R_5$ and $R_6$ are dodecyl or hydrogen and MX is zinc methane sulfonate.

EXAMPLE 9

In this example, 100 grams of 50 percent active compound prepared by reacting 5 moles of dodecylaniline hydrochloride, 2 moles of n-butylaniline hydrochloride and 2 moles of N-methyl toluidine hydrochloride with 7 moles of $SCl_2$ is mixed wih 50 cc of water and 6 grams of zinc methane sulfonate. The reaction mixture is heated and filtered as in Example 5 to yield product filtrate wherein, according to the general chemical formula hereinbefore presented, $n$ is 3, $R_1$ and $R_2$ are hydrogen or methyl, $R_3$, $R_4$, $R_5$ and $R_6$ are methyl, butyl, dodecyl or hydrogen and MX is zinc methane sulfonate.

EXAMPLE 10

Here, 100 grams of 50 percent active compound prepared by reacting 5 moles of dodecylaniline hydrochloride and 3 moles of alpha - naphthylphenylamine hydrochloride with seven moles of $SCl_2$ is mixed with 50 cc of water and 5 grams of zinc acetate. The reaction mixture is heated and filtered as in Example 5 to yield product filtrate wherein, according to the hereinbefore presented general chemical formula, $n$ is 3, $R_1$ and $R_2$ are hydrogen, naphthyl or phenyl, $R_3$, $R_4$, $R_5$ and $R_6$ are dodecyl or hydrogen and MX is zinc acetate.

EXAMPLE 11

In this example, 100 grams of 50 percent active compound prepared by reacting 5 moles of dodecylaniline hydrochloride and 3 moles of diphenylamine with 7 moles of $SCl_2$ is mixed with 50 cc of water and 5 grams of zinc acetate. The mixture is heated and filtered as in Example 5 to yield product filtrate wherein $n$ is 3, $R_1$ and $R_2$ are hydrogen or phenyl, $R_3$, $R_4$, $R_5$ and $R_6$ are dodecyl or hydrogen and MX is zinc acetate.

EXAMPLE 12

Here, 100 grams of 50 percent active compound prepared by reacting 5 moles of dodecylaniline hydrochloride and 3 moles of p,p'-dioctyldiphenylamine with 7 moles of $SCl_2$ is mixed with 50 cc of water and 5 grams of zinc acetate. The mixture is heated and filtered as in Example 5 to yield product filtrate wherein $n$ is 3, $R_1$ and $R_2$ are hydrogen or p-octylphenyl, $R_3$, $R_4$, $R_5$ and $R_6$ are dodecyl or hydrogen and MX is zinc acetate.

The antioxidant properties of the novel compounds of this invention were measured by adding these compounds to a suitable oil and subjecting the oil to oxidation at high temperatures. The test was a bulk oil catalytic oxidation process in which a stream of dry air was passed through a heated sample of the lubricant composition for a time at various elevated temperatures in the presence of iron, copper, aluminum and lead as catalysts. The metal samples consisted of 15.6 square inches of sand-blasted iron wire, 0.78 square inches of polished copper wire, 0.87 square inches of polished aluminum wire, and 0.167 square inches of polished lead surface. The antioxidant activity was evaluated as the ability of the additive to control the acid number (NN) and viscosity (KV) of the oil and prevent them from rising at an unduly rapid rate. The sludge formation during the oxidation was estimated visually. Three base stocks were used in this evaluation. "Base Stock number 1" was a mixed ester of pentaerythritol prepared by reacting an acid mixture of 1 mole of pelargonic acid and 3 moles of commercial valeric acid with 1 mole of technical grade pentaerythritol. "Base Stock number 2" was a 150 ssu solvent refined neutral mineral oil. "Base Stock number 3" was a blend of 62 volume percent furfural 200/210 ssu neutral mineral oil and 38 volume percent solvent paraffinic 150/160 ssu bright mineral oil. Typical analysis of "Base Stock number 3" shows the following properties:

° API — 27.9
Pour, ° F — 20
Flash, ° F — 465
SSU at 100 — 481
SSU at 210 — 63
VI, min. — 95
NN — 0.2
CCR — 0.3
Sulfur, Wt.% — 0.7/1.1
Ash — nil The results of this evaluation are tabulated below in Tables I and II.

Table I

| Oxidation Test in "Base Stock Number 1" | | | | | |
|---|---|---|---|---|---|
| Compound of Example | Conc. Wt. % | Temp. ° F | Δ NN | % Δ KV | Sludge |
| None | — | 425 | 5.8 | 226 | Nil |
| | | 450 | 8.5 | 585 | Trace |
| 2 | 2 | 425 | 2.0 | 33 | Nil |
| | | 450 | 2.5 | 100 | Light |
| 3 | 2 | 425 | 1.6 | 33 | Nil |
| | | 450 | 2.0 | 40 | Trace |

Table II

| Oxidation Test in "Base Stock Number 2" | | | | |
|---|---|---|---|---|
| Compound of Example | Wt. % | Δ NN | % Δ KV | Sludge |
| None | — | 17.0 | 334 | Heavy |
| 2 | 4 | 0.7 | 8 | Nil |
| 3 | 4 | 5.6 | 80 | Trace |

Tests indicated that the compounds of this invention are also useful to improve wear protection properties of lubricants. The products of Examples 2 and 3 were blended in "Base Stock number 3" for the purpose of this evaluation. The test was run in the well known Shell Four-Ball Test at a 60 kg load at 100° F for 30 minutes, with the results appearing in Table III.

Table III

| Compound of Ex. | Wt. % | Wear Scar Diameter (mm) 60 Kg load ½ hr. at Temperature: Room Temp. 1000 RPM | Room Temp. 1500 RPM | 200° F 500 RPM | 200° F 1000 RPM | 390° F 500 RPM | 390° F 1000 RPM |
|---|---|---|---|---|---|---|---|
| None | — | 0.65 | 2.0 | 1.4 | >2.0 | 1.0 | 2.0 |
| 2 | 1 | 0.40 | 0.40 | 0.80 | 1.36 | 0.50 | 0.75 |
| 3 | 1 | 0.55 | 0.70 | 0.55 | 0.60 | — | — |

What is claimed is:

1. A lubricant composition comprising a major portion of an oil of lubricating viscosity or grease thereof and an oxidation property improving amount of the compound having the following formula:

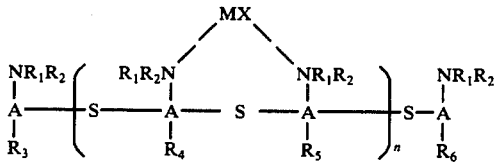

wherein

*n* is an integer of from 1 to about 10;

A is an aromatic hydrocarbon moiety;

M is a polyvalent metal selected from the group consisting of Be, Mg, Ca, Ba, Mn, Co, Ni, Pd, Cu, Zn and Cd;

X is oleate, phenyl phosphate, acetate, phosphate, sulfate, sulfonate, oxide, hydroxide or sulfite;

$R_1$ and $R_2$ are alkyl of from 1 to about 10 carbon atoms, aryl,

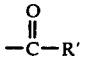

or combinations thereof;

R′ is alkyl of from 1 to about 10 carbon atoms, aryl or hydrogen;

$R_3$, $R_4$, $R_5$ and $R_6$ are hydrogen, alkyl of from 1 to about 200 carbon atoms, aryl, alkyl-substituted aryl where the alkyl substituent is comprised of from 1 to about 200 carbon atoms or combinations thereof.

2. A composition as defined in claim 1 wherein *n* is an integer of from 1 to about 5; A is phenyl or naphthyl and M is selected from the group consisting of Zn and Cd.

3. A composition as defined in claim 2 wherein *n* is an integer of 1, 2 or 3.

4. A composition as defined in claim 3 wherein $R_1$ and $R_2$ are alkyl of from 1 to about 10 carbon atoms and $R_3$, $R_4$, $R_5$ and $R_6$ are alkyl of from 1 to about 200 carbon atoms or hydrogen.

5. A composition as defined in claim 3 wherein $R_1$ and $R_2$ are aryl and $R_3$, $R_4$, $R_5$ and $R_6$ are alkyl of from 1 to about 200 carbon atoms or hydrogen.

6. A composition as defined in claim 1 wherein the compound is present in an amount selected from the range of from about 0.001 weight percent to about 20 weight percent.

7. The composition as defined in claim 1 comprising a major portion of an oil of lubricating viscosity.

8. The composition of claim 1 comprising a major portion of a grease of an oil of lubricating viscosity.

9. The composition of claim 7 wherein the oil of lubricating viscosity is a mineral lubricating oil.

10. The composition of claim 7 wherein the oil of lubricating viscosity is a synthetic lubricating oil.

11. The composition of claim 10 wherein said synthetic lubricating oil is made by reacting monopentaerythritol and a mixed $C_4$–$C_{10}$ aliphatic monocarboxylic acid.

* * * * *

UNITED STATES PATENT AND TRADEMARK OFFICE

CERTIFICATE OF CORRECTION

PATENT NO. : 4,066,561

DATED : January 3, 1978

INVENTOR(S) : John C. Nnadi

It is certified that error appears in the above-identified patent and that said Letters Patent are hereby corrected as shown below:

Column 2, line 52, "salt of complex" should read -- salt or complex --.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*